United States Patent [19]

Linka et al.

[11] Patent Number: 4,848,410

[45] Date of Patent: Jul. 18, 1989

[54] MAGNETIC SHUTTLE DRIVE SYSTEM FOR A MULTI-SYSTEM WEAVING LOOM

[75] Inventors: Adolf Linka; Frank Lanthaler, both of Hechingen/Bechtoldsweiler; Heinrich Frommelt, Grosselfingen, all of Fed. Rep. of Germany

[73] Assignee: Lindauer Dornier Gesellschaft m.b.H., Lindau/Bodensee, Fed. Rep. of Germany

[21] Appl. No.: 131,637

[22] Filed: Dec. 11, 1987

[30] Foreign Application Priority Data

May 30, 1987 [DE] Fed. Rep. of Germany ..... 3718307

[51] Int. Cl.[4] ..... D03D 49/26

[52] U.S. Cl. ..... 139/134; 139/436; 139/439

[58] Field of Search ..... 139/436, 134, 439, 196.2

[56] References Cited

U.S. PATENT DOCUMENTS

| | | | |
|---|---|---|---|
| 3,618,640 | 11/1971 | Linka . | |
| 3,626,990 | 12/1971 | Linka . | |
| 3,749,135 | 7/1973 | Linka . | |
| 4,073,319 | 2/1978 | Linka et al. | 139/134 |
| 4,410,017 | 10/1983 | Linka . | |
| 4,762,153 | 8/1988 | Chuang et al. | 139/134 |

FOREIGN PATENT DOCUMENTS

| | | | |
|---|---|---|---|
| 83864 | 5/1955 | Czechoslovakia . | |
| 1066958 | 10/1959 | Fed. Rep. of Germany . | |
| 1287526 | 1/1969 | Fed. Rep. of Germany . | |
| 3346030 | 6/1985 | Fed. Rep. of Germany . | |
| 581215 | 10/1976 | Switzerland . | |
| 709299 | 5/1954 | United Kingdom | 139/134 |

*Primary Examiner*—Andrew M. Falik

*Attorney, Agent, or Firm*—Frishauf, Holtz, Goodman & Woodward

[57] ABSTRACT

To provide for positive guidance of shuttles in a multi-system traveling shed weaving loom, in which the shuttles move continuous, endless loop path, having a straight portion (15*a*) and two essentially semi-circular curved return path portions (15*b*), the curved return path portions are defined by a pair of guide strips or rails (32, 42) spaced from each other by a sufficient distance to accomodate the shuttles therebetween as they travel in the curved path, the inner guide strip (32) being formed of non-magnetic material. The shuttles carry permanent magnets (36) and travelers (16) carry, on a leaf spring (30), drive elements (25) having permanent magnets (26) interacting with the magnets (36) on the shuttles, the drive elements being pressed against the inner surface of the non-magnetic guide strip in the curved portion (15*b*) of the path and against a guide reed leaf (10) in the straight portion of the path. Tapered transition strips (33) connect the guide reed leaf and the curved inner strip to provide for smooth transition between the guide reed and the thinner inner guide strip (32).

18 Claims, 4 Drawing Sheets

6
16
17
9
15a
17
10
20
33
21
MOTOR
M 25
36
15a
10
33
III
III
32
30
25
9
15b
32
42

MAGNETIC SHUTTLE DRIVE SYSTEM FOR A MULTI-SYSTEM WEAVING LOOM

Reference to related patent, the disclosure of which is hereby incorporated by reference:

U.S. Pat. No. 3,749,135.

Reference to related disclosure, illustrating the state of the art: German Patent Disclosure Document DE-OS No. 33 46 030.

Reference to related applications, the disclosure of which is hereby incorporated by reference, and assigned to the assignee of this application:

U.S. Ser. No. 146,263, filed Jan. 20, 1988, LINKA et al

U.S. Ser. No. 123,376, filed Nov. 20, 1987, LINKA

U.S. Ser. No. 163,619, filed Mar. 3, 1988, LINKA et al

U.S. Ser. No. 123,597, filed Nov. 20, 1987, LINKA.

The present invention relates to a multi-system or multi-feed back-to-back traveling shed weaving loom having a plurality of shuttles which are driven by a magnetic drive means through a path which extends essentially linearly through a weaving shed, and then about a part-circular, typically half-circular path to return through yet another essentially linear shed, to form an endless shuttle path, and especially to a shuttle drive system in which the curved path portion of the shuttle is clearly defined and the shuttles are positively guided in this curved path portion.

BACKGROUND

In such traveling shed weaving looms, the path of the shuttle is guided across the width of the fabric at least over a substantial portion of the longitudinal path portion by a guide reed. The shuttle is guided on a guide reed and moved, by magnetic coupling to magnetic shuttle moving elements, which are carried along the shed, for example by an endless chain, by being coupled together or the like.

U.S. Pat. No. 4,410,087, to which German Pat. No. 30 16 182 corresponds, describes a multi-system or multi-feed, back-to-back weaving loom, i.e. a loom with traveling shed built in back-to-back construction. On the front side and back side, respectively, the shuttles pass through a straight portion of their guide path and through the shed, so that, in the straight portion, one or more fabric webs can be made. The shuttles are driven by drive elements which are either coupled together or coupled to an endless chain. The drive elements carry permanent magnets on the side facing the shed and the shuttle likewise carries permanent magnets which are in magnetically coupled relation to the drive element magnets. The magnetic coupling provides for moving of the shuttles, as set forth in general principle in U.S. Pat. No. 3,618,640, Linka, to which German Pat. No. 1 785 147 corresponds.

The two essentially straight portions of the guide path of the shuttle are coupled by curved return portions in which the shuttle leaves the shed, and is guided in an essentially semi-circular return path. Two sprockets are located in the region of the return path over which either the drive chain or the connected drive elements and drive segments are carried which, upon passing through the return path, are spread out in fan shape. Before the shuttles can enter the shed in the portion next to the curved portion, that is, at the transition from the curve to the straight portion, it is necessary to guide the shuttle again on the guide reed. On the straight guide portions, the essentially straight guide reed guides the shuttles. A stable slide path is thus formed for the shuttles, which are magnetically coupled to the drive segments. The reed elements simultaneously form a guide for the weft beating-up lamellae.

The shuttles are coupled in the region of the semi-circular return paths by being directly coupled to the drive elements, so that, between the facing pole surfaces of permanent magnets of the drive segments and of the shuttles, the only interposed material is the plastic sliding foil formed on the shuttles. Such a plastic sliding foil is located on the shuttles on the pole surfaces facing the reed, in order to provide for low-friction sliding movement of the shuttles on the reed. The tiny air gap which results between the facing pole surfaces and the permanent magnets provides for substantial attractive forces. The basic problem arises, however, that the shuttle, after passing the semi-circular return path portion of the guide track, again must be placed on the respective straight-line portion of the guide path or guide track formed by the reed. The reed elements or lamellae have a finite width, based, for example, merely on mechanical strength considerations. Thus, as the shuttle runs on the reed, the air gap between the permanent magnets, the shuttle and the drive segments must be increased with respect to the gap formed only by the low-friction foil. Consequently, the shuttle must be moved counter the attractive force to increase the air gap. Of course, separation of the shuttle which would lead to separation from the drive elements due to an abrupt interposition of resistance against movement in the guide path of the shuttle must be absolutely avoided. Abrupt change in magnetic forces and movement of the shuttle also results in substantial noise and excessive wear and tear on the slide surfaces of the shuttles.

A typical speed of a shuttle is about 1.4 m/sec. If adjacent shuttles are spaced from each other by, for example, 20 cm, seven shuttles will engage the reed on a run-on portion thereof each second. The continuous engagement of the shuttles with the reed causes noise and subjects the slide surface to wear, both of which are objectionable and should be avoided.

THE INVENTION

It is an object to provide for smooth and low-noise transition of the shuttles between the curved shuttle path and the reed, by insuring that the transition is of low wear and tear, gentle, and reliably prevents separation of the drive segments which magnetically retain the shuttles to move the shuttles along the operating paths.

Briefly, the curved shuttle path is defined by two guide strips, at least one of which is of non-magnetic material, leaving a gap between the inner and outer guide strips wide enough to accomodate the shuttle as it travels in the curved path. The shuttles will form a portion of a chord, so that the spacing between the guide strips has to be slightly greater than the width of the shuttles. Magnetic drive elements are coupled to move with the shuttle drive structure, for example drive blocks or the like coupled to an endless chain, the magnetic drive elements being resiliently biassed for engagement against the reed and, when reaching the curved region, engage against one of the guide strips, for example the inner guide strip, which is the one, then, which must be of non-magnetic material. Thus, the shuttles, which include magnetically responsive elements, for example permanent magnets thereon, are positively guided in the curved path by engagement with the respective guide strips. The guide strips, typically, are located along essentially a semicircle, concentric with respect to each other, said gap or space accomodating the shuttle therebetween as the shuttle is moving in the circular path.

The essentially semi-circularly bent guide strip or element made of non-magnetic material insures effective cooperation of the shuttle magnets or magnetically responsive elements with the magnets which are resiliently engaged with the non-magnetic guide strip. The thickness of the guide strip is, preferably, so selected that the resulting non-magnetic gap does not detract from magnetic attractive forces to such an extent that separation between the guide elements and the shuttles may occur. In other words, the non-magnetic guide strip should be so thin that the shuttle and the drive elements are securely magnetically coupled together. The radially outwardly positioned guide strip prevents, in any event, undesired separation of a shuttle due to centrifugal force, and thus contributes to maintenance of conjoint movement of the drive elements and the shuttles while, additionally, functioning as a safety guide or safety device.

Depending on the construction of the weaving loom and its elements, and the operating speed thereof, it is possible to utilize a non-magnetic guide element which has the same thickness as the immediately adjacent reed. This is particularly possible in machines having low operating speeds. When the reed and the next adjacent guide strip have the same thickness, a gentle stepless transition of the shuttle from the guide strip to the reed is insured. For higher speed operation, however, and, in general, for many other applications, it is equally appropriate to provide a non-magnetic transition strip at least on one side, which is made in wedge shape or ramp form, to insure stepless smooth transition for the shuttle and/or the drive elements upon transition from the reed to the curved path portion. This transition or connecting strip or sheet which may be in leaf or lamella form, can be an element separate from the reed or the curved strip. Particularly simple structural relationships pertain, however, if the connecting portion is unitary and has the curved strip, with a suitably shaped profile which provides for transition from the thinner curved strip region to the thicker reed region.

A ramp or wedge-like connecting element insures gentle smooth transition from the curved guide strip to the thicker reed. Such a transition element can also be located on the run-out or run-off side of the reed in order to provide also at that position for gentle and low-noise transition of the shuttle from the reed to the curved guide portion of its path.

The guide strips or guide elements may, advantageously, be formed as guide rails which extend at least over the entire curved portion of the path of the shuttle. The particular profile of the shape of such rails or strips may depend on the particular shape of the shuttles which are used.

DRAWINGS

Figure 2:
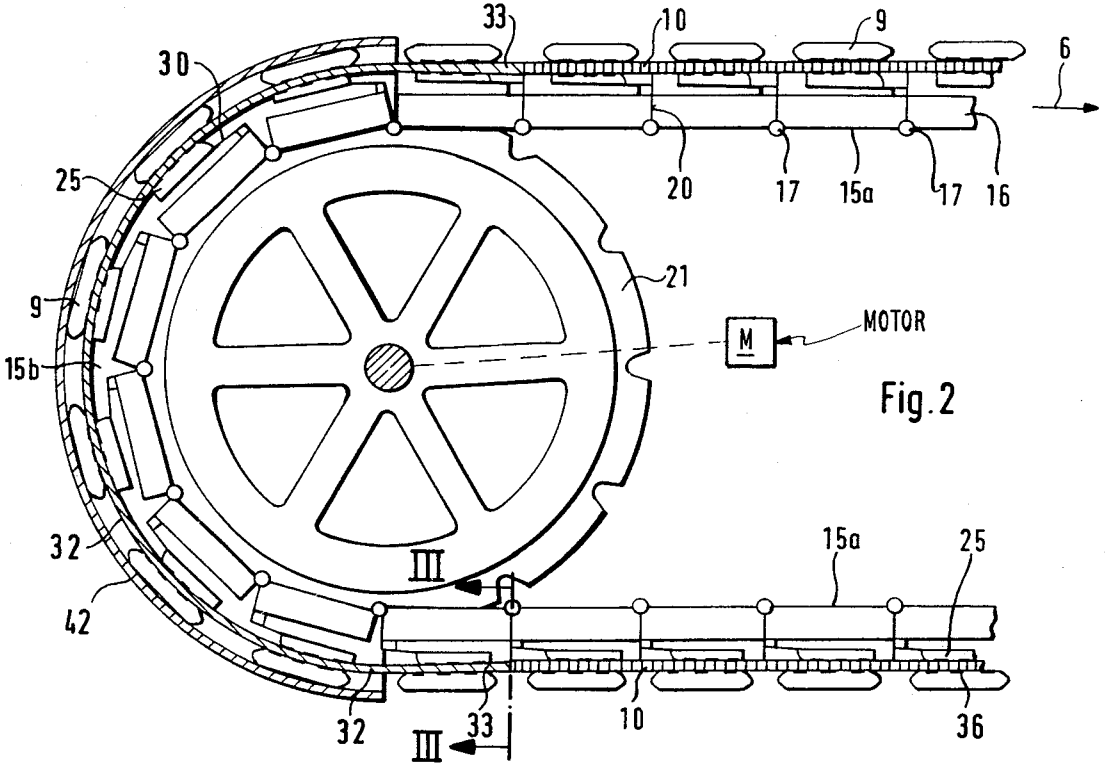
FIG. 2 is a fragmentary top view cut along a horizontal plane located at the line II—II of FIG. 1, and illustrating, in fragmentary representation, a portion of the shuttle path including the curved return path.
Figure 3:
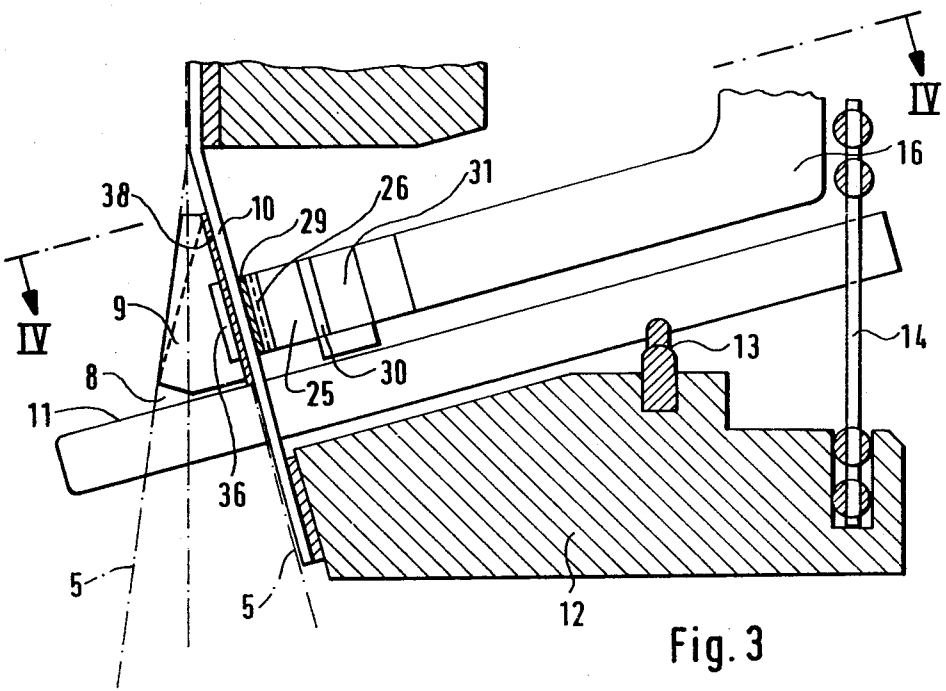
Figure 4:
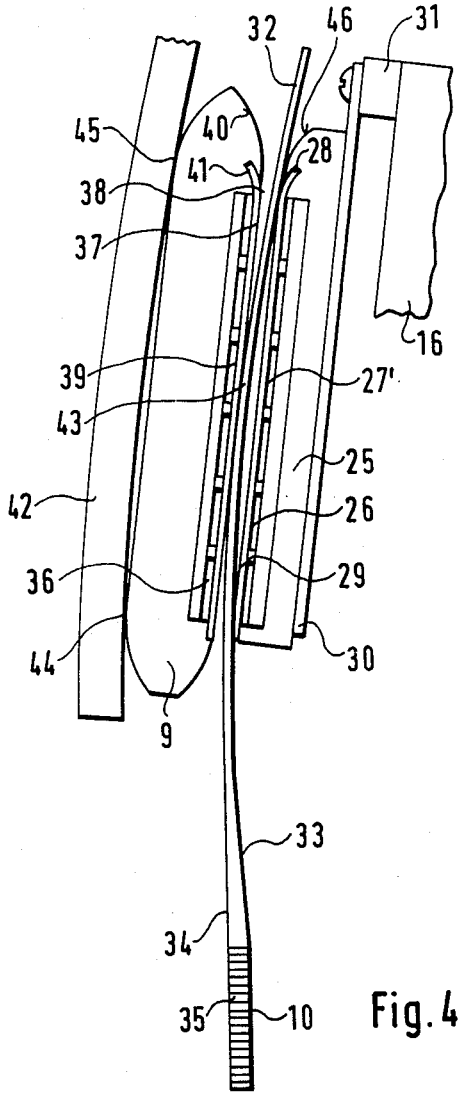

FIG. 3 is a section along line III—III of FIG. 2, in schematic fragmentary representation, and to a different scale, of a portion of the guide path for the shuttle and the shuttle, including drive arrangements therefor; and FIG. 4 is a top view of a portion of the curved return path for the shuttle illustrating the position of the shuttle therein, and a portion of the transition guide element between the straight and curved path of the shuttle.

DETAILED DESCRIPTION

The multi-system weaving loom is constructed as a flat loom in back-to-back construction. It has a machine frame 1. It is constructed to permit simultaneous manufacture of four cloth webs 2. Each of the webs 2 is rolled up on a cloth beam 3, which is rotatably supported on the machine frame 1. The warp beams 4, likewise rotatably supported on the machine frame 1, provide warp threads 5, which are guided over suitable guide rollers. The warp threads 5 are moved alternately away from each other in a progressive movement in the direction of the arrow 6. The movement is transverse to the direction of the warp threads 5 to form sheds 8 (FIG. 3). Heddles 7 form the sheds. Each one of the sheds is passed by a shuttle 9, the construction of which is shown in detail, for example, in FIGS. 3 and 4.

Figure 1:
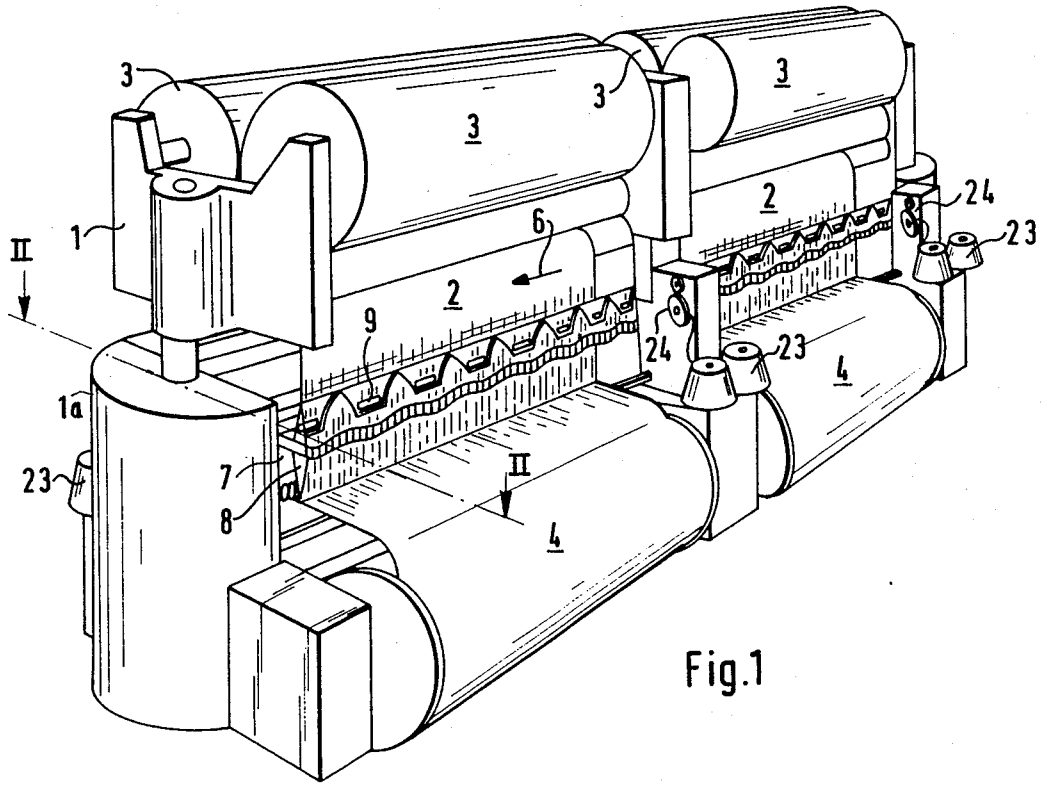
FIG. 1 is a perspective view of a multi-system weaving loom in back-to-back construction and including the subject matter of the present invention.

The shuttles 9 run behind each other in predetermined spacing, as best seen in FIGS. 1 and 2, on a guide path which is formed on one side by a guide reed 10 and, on the other, side by the beating-up lamellae 11 (FIG. 3). The lamellae 11 are pivotably supported on a bed 12, secured to the machine frame. The lamellae 11 are pivotable about a pivot point 13 for beating-up of the weft thread. Lateral guidance is obtained by the reed elements of the guide reeds 10 on the one hand and, on the other, by guide elements 14, fitted into the bed 12, in respective spacing from each other. The mechanism moving the lamellae 11 is not shown in detail; it is well known and can be of any suitable construction. Basically, it includes two rollers which move in common with the shuttle 9 and cause tipping of the lamellae 11 about the pivot point 13.

The guide path, along which the shuttle 9 runs, has two straight portions **15*a* (see FIG. 2) and two semi-circular return portions 15*b*, adjoining the respective straight portions. The shuttles 9 are moved by shuttle moving elements or drive segments 16, also known as travelers, in the same direction. The travelers are coupled together by joints 17 (FIG. 2) or may be secured to an endless chain. When the shuttles pass through the straight portion 15*a*, the travelers 16 may engage each other with their adjacent end surface 20, as seen in FIG. 2**; they may also be positioned spaced from each other.

The travelers 16, forming the drive or moving elements which are joined into an endless chain or movable structure, are guided in the curved path portions **15*b* over sprockets 21 rotatable about vertical axes. Only one sprocket is visible in FIG. 2. One of the sprockets, at least, is driven by a drive source or motor M which drives the sprockets so that the travelers 16 will be moved together in the direction of the arrow 6, FIGS. 1 and 2**.

The respective drive segments or travelers 16 are guided on suitable guide rails or guide tracks secured to the machine frame 1. At the bottom of the drive segments, that is, on the side facing the heddles 7, the drive segments carry control tracks, for example in the form of grooves, in which butts from the heddles 7 engage for movement of the heddles and hence for formation of the shed, as described in detail in U.S. Pat. No. 3,749,135, to which German Pat. No. 1 963 208 corresponds.

Before the shuttles 9 enter the shed 8 of one of the fabric webs 4, a weft thread supply device 24 (FIG. 1) supplies a piece of weft thread of predetermined length from a suitable supply spool 23. Supply of weft threads to the shuttle is described, for example, in U.S. Pat. No. 3,626,990.

Each one of the travelers 16 carries an elongated drive element 25, preferably made of plastic material. The elongated element 25 is supported on the side of the traveler 16 which faces the shuttle 9. The drive element 25 is preferably bowed at the end portions to form a runner. Between the bowed end portions, the drive element 25 has a flat surface 27' in which a plurality of permanent magnets 26 are set. A suitable number is six permanent magnets, selected for the present example. The permanent magnets 26 are located, spaced from each other, adjacent each other in the drive element 25. A bowed inwardly curved surface 27 joins the flat surface 27', the surface 27 being bowed backwardly towards the traveler 16. A transversely extending groove 28 (FIG. 4) is located in the region of the surface 27, in which a thin slide foil 29, formed as a self-adhesive foil, is pinched. The slide foil 29 is made of a low-friction or friction-reducing material, for example Teflon (R), that is, tetrafluorethylene. The foil 29 completely covers the surface 27' to form, at the outside thereof, a low-friction slide surface.

In accordance with a feature of the invention, the drive element 25 is secured by means of a leaf spring 30 attached to an attachment boss 31 located on the front side of the associated traveler 16. The leaf spring 30 projects from the traveler 16 to resiliently support the drive element 25, and permitting limiting movement transverse to the shuttle 9. The leaf spring 30 resiliently presses the drive element 25 with elastic bias force against the reed 10 in the region of the shed or, in the region of the curved return path **15*b*, against a curved, essentially semi-circular guide strip or rail 32, as best seen in FIGS. 2 and 4**.

In accordance with a feature of the invention, the guide strip or rail 32 is made of non-magnetic material, and extending, essentially semi-circularly, concentric to the respective sprocket 21. The strip 32 is thinner than the reed 10 which is located on the respective straight path **15*a* of the guide path for the shuttle. A suitable dimension may, for example, be 1 mm for the bent or curved guide strip 32; the thickness of the reed leaf 10 may be 3–4 mm. The transition between the strip 32, which has a constant thickness throughout, and the adjacent reed leafs 10 is formed by a ramp or wedge-shaped connecting leaf 33 (FIG. 4), likewise made of non-magnetic material, and which, in the example selected, is unitary with the strip 32, by being unitarily formed thereon. The arrangement is so constructed that the outside of the guide path, shown at 34 (FIG. 4), joins smoothly and steplessly on the outer circumference or surface of the glide and guide path 35 of the respective reed leaf 10. The inside of the drive element 25 is guided smoothly and gently on the reed leaf 10 over the gradually thickening path, formed by the ramp section 33, so that there is smooth transition from the reed leaf 10 to the guide strip 32, providing for gentle and smooth movement of the drive element 35** thereover in either direction.

A shuttle 9 is located opposite each one of the drive elements 25, and coupled thereto by magnetic attraction by the permanent magnets in the drive element 25. To increase the attractive magnetic force, each one of the shuttles 9 has permanent magnets 36 located on the side facing the drive element 25. The pole surfaces of the magnets are covered by a slide, low-friction foil 37 (FIG. 4), made of plastic material. The arrangement of the polarity of the permanent magnets 26, 36 is, respectively, described in U.S. Pat. No. 3,618,640, Linka, to which German Pat. No. 1,785,147 corresponds. The interaction of the magnetic forces by the permanent magnets 26, 36 provides for magnetic coupling of the shuttles 9 to the drive elements 25 and hence to the drive segments or travelers 16. The slide surface 38 formed by the foil 37 of the elongated shuttles 9 is defined by an essentially plane surface 39 of the shuttle 9. The permanent magnets 36 are recessed within the shuttle 9, so that the pole surfaces are flush. The slide foil 37, similar to the foil 29 on the drive element 25, is pinched in a groove 41. The flat surface 39 extends in a smoothly curving bowed run-on surface 40, in which the transverse groove 41 is formed. The slide foil 37 is a self-adhesive foil, and, likewise, is made of low surface friction material, for example polytetraflourethylene (PTFE).

The slide foils 29, 37 are interchangeable. Other constructions may be used, in which the slide foils 29, 37 are replaced by permanently applied plastic or plastic resin material having low-friction characteristic. Rather than using foils, thin plates of suitable material, for example of PTFE may be used instead of foils 29, 37, as desired.

In accordance with a feature of the invention, an outer guide strip or rail 42 is located, concentrically with the guide strip 32, and leaving a track space for the shuttles. FIGS. 2 and 4 best show the association of the outer rail 42 and the inner rail or strip 32. The outer rail 42, likewise, is semi-circularly bent or curved. The radial spacing of the strip or rail 42 from the strip or rail 32 is so selected that the shuttles which become positioned in the return path portion **15*b* engage, with the side facing the drive element 25, the guide strip 32 at a specific location 43. Location 43, looked at in the direction of movement of the shuttles 9, is approximately in the center of the plane surface 39 of the shuttle. At the opposite outer side, the shuttles 9 engage the outer guide strip or rail 42 at two localized positions 44, 45, close to the ends of the respective shuttle, as best seen in FIG. 4**.

In accordance with a feature of the invention, the shuttles are positively located in the guide return path **15*b* by a three-point support. Thus, as the shuttles 9 pass the curved return path 15*b*, they are subjected to close magnetic coupling with the drive element 25 at the location 43, while being stably and reliably guided and positioned by engagement with the outer guide strip or rail 42 at the end points of the shuttle, at the engagement positions 44, 45. As seen in FIG. 4, the essentially straight shuttle will be in a part-chord position within the curved guide track fromed by the space or gap between the strips 32 and 42**.

OPERATION

When the shuttles 9 pass the straight guide paths **15*a* in the direction of the arrow 6, weft threads stored in the respective shuttles are inserted in the respectively associated shed 8. The shuttles pass through the sheds in predetermined distances, one behind the other, magnetically coupled to the drive elements 25 which, in turn, are coupled to the travelers 16, which move along the length of the fabric upon rotation of the sprocket 21. The slide foil 37 guides the shuttles 9 on the reed leaf 10, which limits the guide path of the shuttle in the straight portion 15***a* towards the inside of the machine, the shuttles being retained against the reed leaf 10 by the magnetic forces due to the permanent magnets 26, 36 on the drive elements 25 and on the shuttles 9.

The drive elements 25, likewise are pressed towards the inside of the guide reed 10, engaging the guide reed 10 with the slide foil 29, and being guided thereon. The thickness of the guide reed 10 defines the non-magnetic gap, which can also be referred to as an "air gap", between the associated pole surfaces of the permanent magnets 26 and 36.

When the shuttles leave the leftmost fabric web 4, as seen in FIG. 1, and enter the essentially semi-circular return path portion 15*b*, the shuttles leave the slide surface 35 of the reed leaf 10, smoothly, and without abrupt movement or stepped movement, to then run on the slide or guide surface 34 of the transition or connecting leaf or element 33, to then run on the guide strip 32. The drive element 25, due to its springy elastic support by spring 30, remains in engagement with the inner surface of the connecting element 33 and then with the guide strip 32. Initially, and in the region of the reed leaf 10, the element 35 is in continuous surface engagement over the entire slide surface. Upon moving into the curved portion, the element 25 will change from the entire surface engagement with respect to the reed leaf 10 to engagement at two localized portions on the strip 32, namely at a leading and trailing position of the drive element 25, so that the flat surface 26 thereof will form a chord with respect to the essentially semi-circular guide strip 32.

The transition element 33 is preferably slightly bent outwardly, as best seen in FIG. 4. The leading end of the shuttle 9, running off the reed leaf 10, is lifted by the outwardly bent portion of the surface 34 off engagement with the connecting or transition element 33. The leading end of the shuttle 9 will then enter the gap between the guide strips 32, 42, by engaging at the location 45 the inner surface of the outer guide strip 42. As clearly seen in FIGS. 2 and 4, the shuttle is constrained in a position in which its slide surface 38 extends essentially tangentially to the outer surface of the inner guide strip 32 while being supported at the inner side of the outer guide strip 42 at the support positions 44, 45 at the trailing and leading ends of the shuttles, respectively. Thus, the shuttle is radially outwardly supported by the engagement positions 44, 45 which are located, at least approximately symmetrically with respect to the central engagement position 43 with the inner strip 32, facing the drive element 25.

Each one of the shuttles 9 thus travel from the reed leaf 10 to the circular guide path 15*b*, guided by the guide strips 32 and 42. At the outlet end, a similar transition section 33 connects the inner guide strip 32 to the reed leaf 10 at the other side of the machine for guidance thereon. Since the outer surfaces 34, 35 of the transition element 33 and of the reed leaf 10, respectively, merge smoothly and steplessly into each other, the shuttle 9 is guided on the reed 10 likewise smoothly and without jolts or abrupt changes in direction or movement. At the side opposite the shuttle, the associated drive element 25 fits against the respective transition element 33 and then against the reed leaf 10, likewise running smoothly over the essentially wedge-shaped or ramp-like surfaces. The end portions of the surfaces 27 on the drive element 25, and of the shuttle 9, as seen at 40, which are bowed away from the respective engagement surfaces of the reed leaf 10, the transition zones, and the strips 32, 42, assist in smooth movement of the respective drive elements 25 and the shuttle 9 and facilitate passage of the shuttle 9 as well as of the drive element 25 over the essentially semi-circular curved path 15*b*.

After leaving the curved path 15*b*, a weft thread is inserted into the shuttle 9 before the shuttle 9 enters the next adjacent fabric section 4, so that the shuttle 9 can then insert the next weft thread into the shed 8 through which it passes.

The three-point support of the shuttles in the curved path substantially decreases frictional losses, since the engagement surfaces of the shuttles with the respective guide strips or rails are of limited extent. Supporting the shuttle so that it is tangentially engaged against the outer surface of the inner strip 32, and so that contact is at only one specifically defined position, decreases the air gap between the associated pole surfaces of the permanent magnets of the shuttle and of the drive element 25. At the engagement of the shuttle with the inner strip 32, a magnetic attractive force is a maximum. The shuttle is in unstable equilibrium engagement on the guide strip 32, yet is stabilized by the two support positions 44, 45, engaging the outer strip 42. The three-point support, thus, prevents wobble or oscillation of the shuttle and provides for precise transition of the shuttle from the curved path into the straight path portion.

Resiliently supporting the drive elements 25 by the spring 30 has the advantage that continuous engagement of the drive elements with the reed leaf 10 and, then, with the curved strip 32, is insured. A leaf spring 30 is a preferred and simple resilient support. Providing low-friction running or sliding surfaces on the shuttle and on the drive element 25 and, preferably, also on the associated guide elements 10, 33, 32, 42, further reduces friction. The slide surfaces are made smooth and are so positioned that low-friction paired guidance of the shuttle on the respective surfaces is obtained. Preferably, the terminal surfaces of the shuttle 9, the drive element 25 and the respective guide strips 32, 42 are formed with backwardly bent run-on surfaces which permit the shuttle to slightly tip or wobble and permit the shuttle to pass over contaminants, fluff or the like, which might have inadvertently accumulated on the guide strips 32, 42, the reed leaf 10, or the transition element 33. To improve the sliding characteristics, while providing for high wear resistance, a thin layer of non-magnetic, low-friction material, such as a suitable coating of lacquer, plastic or plastic material may be used. A thin foil or plate of low-friction material has been found eminently suitable and is preferred, since it can be readily adhered to the shuttles 9 and/or the drive element 25, and can be replaced, if worn. A thin foil or plate can also be located in the region of the run-on surface, removably attached to the shuttle and/or the drive element 25, to permit easy replacement if the run-on surface becomes worn. The attachment in the region of the run-on surface should be so made that, in running direction, the surface is smooth, without having any steps, ridges or burrs on which, possibly, warp threads might catch. A self-adhesive foil is particularly preferred since additional holding and guiding arrangements on the shuttle or the drive element 25, respectively, can then be eliminated.

The permanent magnets can readily be located with a surface flush with the shuttle, to be covered only by the non-magnetic slide foil or plate, so that the outer surfaces of the shuttle will present to the threads in the shed a smooth, uninterrupted surface. FIG. 1 additionally shows an outer shield 1*a*, omitted from FIG. 2 for clarity, to protect the operating mechanism in the return path.

Various changes and modifications may be made within the scope of the inventive concept.

We claim:

1. Multi-system or multi-feed weaving loom having
means for forming a shed (8);
means for defining a straight shuttle guide path (15*a*) for guiding a shuttle (9) through the shed;
means for defining a curved shuttle guide path (15*b*) merging into said straight shuttle guide path;
a guide reed (10) located adjacent said straight guide path (15*a*) through the shed for guiding movement of the shuttle (9) through the shed;
a plurality of shuttle moving means (16) located adjacent the guide paths (15*a*, 15*b*) for moving the shuttles in said guide paths;
shuttle magnetically responsive means (36) located on the shuttle;
magnetic means (26) movable with said shuttle moving means and positioned for magnetic coupling with said shuttle magnetically responsive means (36); and
drive means (21) coupled to the shuttle moving means (16) for moving said shuttle moving means and hence the shuttles, by magnetic coupling, through the shed;
and wherein, in accordance with the invention,
the means for defining said curved shuttle guide path (15*b*) for the shuttle comprises
guide strip means (32) of non-magnetic material curved to define said guide path, and positioned at a radially inner side of the curved guide path;
a guide element means (42) located at a radially outer side of said curved path; and
wherein magnetic drive elements (25), are provided movably and coupled to the shuttle moving means (16) and resiliently biased for engagement against the guide reed (10) and said guide strip means (32), said magnetic drive elements carrying said magnetic means (26) and magnetically interactively coupled to the shuttle magnetically responsive means,
said shuttles being guided in the curved path (15*b*) by engagement with the inner guide strip means (32) and the outer guide element means (42).

2. The loom of claim 1, wherein said curved path (15*b*) is a part-circular path;
said guide strip means (32) is part-circular; and
wherein said guide element means (42) is a strip element concentric with said guide strip means and spaced from said guide strip means by a distance sufficient to accomodate the shuttles therebetween while the shuttles are moving in said part-circular path.

3. The loom of claim 1, wherein the guide strip means (32) is thinner than said guide reed (10).

4. The loom of claim 3, further including a connecting or transition strip means (33) extending between the guide reed (10) and a terminal portion of said guide strip means, said connecting or transition strip means comprising non-magnetic material and including a smooth continuous guide surface (34, 35) on one side for the shuttle and on the other side for said magnetic drive elements (25), said connecting or transition strip means smoothly merging at its terminal ends with the guide reed (10) and said guide strip means, respectively.

5. The loom of claim 4, wherein the connecting or transition strip means (33) comprises an extending portion of the guide strip means (32) and unitary therewith.

6. The loom of claim 1, wherein said outer guide element means (42) comprises a rail element (42) extending essentially parallel to at least the curved portion of the guide path (15*b*).

7. The loom of claim 1, including engagement positions (43, 44, 45) localized on said shuttle and forming engagement surfaces or lines having an extent substantially less than the longitudinal extent of said shuttles, said engagement positions engaging, respectively, the guide strip means (32) and the guide element means (42) upon travel of a respective shuttle in the curved path (15*b*).

8. The loom of claim 7, wherein said engagement positions comprise two external engagement positions (44, 45) for engagement of a shuttle against the outer guide element means (42), said outer engagement positions being located close to the end portions of the shuttle.

9. The loom of claim 1, further including spring means (30) coupling the respective drive elements (25) to said shuttle moving means (16).

10. The loom of claim 9, wherein said shuttle moving means comprises a plurality of travelers (16);
and the spring means comprises a leaf spring (30) coupling a traveler to a drive element (25), said spring means providing a resilient bias force for engagement of the drive element against the guide reed and, respectively, said guide strip means (32).

11. The loom of claim 1, including a low-friction slide surface formed on a surface of at least one of the shuttles (9) facing the drive elements, said low-friction surface being positioned for surface engagement with the guide reed and the guide strip means, respectively.

12. The loom of claim 11, wherein at least one of the shuttles (9) and the drive elements (25) are formed at least at their leading ends with run-on surfaces (27, 40) bent away from the guide reed and the guide strip means, respectively.

13. The loom of claim 11, wherein said low-friction surface comprises a thin layer of non-magnetic low-friction or friction-reducing material.

14. The loom of claim 13, wherein said layer comprises a thin foil (29, 37) or a thin plate of low-friction material, secured, respectively, to the shuttle and the drive element (25).

15. The loom of claim 13, wherein said low-friction surface comprises a self-adhering foil element (29, 37).

16. The loom of claim 13, wherein the shuttle magnetically responsive means comprises permanent magnets (36) having pole surfaces flush with the shuttle surface and covered by said thin layer of non-magnetic low-friction material.

17. The loom of claim 13, wherein the magnetic means for magnetically interactive coupling to the magnetically responsive means of the shuttle comprise permanent coupling magnets (26) secured to and recessed in said drive elements (25) and having pole surfaces flush with said elements and covered with said non-magnetic low-friction material.

18. The loom of claim 11, wherein said low-friction surface comprises a thin foil or plate element (29, 37) removably secured to the shuttle (9) or the drive element (25), respectively, in the region of the run-on surface (27, 40).

* * * * *